US009060563B2

(12) United States Patent
Tsai

(10) Patent No.: US 9,060,563 B2
(45) Date of Patent: Jun. 23, 2015

(54) ARCH SUPPORT INSOLE FOR SHOES

(71) Applicant: Fusco Industrial Corporation, Taipei (TW)

(72) Inventor: Chen-Yu Tsai, Taipei (TW)

(73) Assignee: Fusco Industrial Corporation, Taipei (TW)

( * ) Notice: Subject to any disclaimer, the term of this patent is extended or adjusted under 35 U.S.C. 154(b) by 323 days.

(21) Appl. No.: 13/845,928

(22) Filed: Mar. 18, 2013

(65) Prior Publication Data

US 2014/0259755 A1 Sep. 18, 2014

(51) Int. Cl.
*A43B 7/14* (2006.01)

(52) U.S. Cl.
CPC ..... *A43B 7/142* (2013.01); *A43B 7/1415* (2013.01); *A43B 7/144* (2013.01); *A43B 7/1445* (2013.01); *A43B 7/149* (2013.01)

(58) Field of Classification Search
CPC ..... A43B 7/14; A43B 7/1405; A43B 7/141; A43B 7/1415; A43B 7/1425; A43B 7/142; A43B 7/144; A43B 13/38; A43B 17/00
USPC ..... 36/43, 44, 145, 166, 173, 174, 180
See application file for complete search history.

(56) References Cited

U.S. PATENT DOCUMENTS

| | | | | |
|---|---|---|---|---|
| 4,841,648 | A * | 6/1989 | Shaffer et al. | 36/43 |
| 5,784,811 | A * | 7/1998 | Mauch | 36/141 |
| 7,140,126 | B2 | 11/2006 | Crane et al. | |
| 2006/0123663 | A1* | 6/2006 | Swensen | 36/43 |
| 2009/0049712 | A1* | 2/2009 | Steszyn et al. | 36/91 |
| 2009/0071038 | A1* | 3/2009 | Luthi et al. | 36/91 |
| 2012/0174436 | A1* | 7/2012 | Hanak | 36/43 |
| 2012/0246971 | A1* | 10/2012 | Donzis et al. | 36/43 |
| 2012/0255199 | A1* | 10/2012 | Tzeng | 36/43 |
| 2014/0259755 | A1* | 9/2014 | Tsai | 36/43 |
| 2015/0000157 | A1* | 1/2015 | Hikichi | 36/43 |

* cited by examiner

*Primary Examiner* — Marie Bays
(74) *Attorney, Agent, or Firm* — Wang Law Firm, Inc.; Li K. Wang; Stephen Hsu

(57) ABSTRACT

An arch support insole includes a basic body made from soft flexible material having a top surface, a palm support portion and an arch support portion, wherein the palm support portion has a rear part, a front part with a width gradually increased from said rear part, an arched lateral side conforming to an arch of human foot, a topmost planar surface and a curved side surface gradually descending from the topmost planar surface. The topmost planar area is spaced apart from the top surface of the basic body at 7 mm~9 mm. The arch support portion surrounds the rear part and the curved side surface of the palm support portion, has an upwardly curved top surface with a topmost point which is spaced from the top surface of the basic body at 1 mm~4 mm.

7 Claims, 5 Drawing Sheets

ARCH SUPPORT INSOLE FOR SHOES

BACKGROUND OF THE INVENTION

1. Field of the Invention

The present invention relates to an insole, more particularly to arch support insoles which is adapted to be utilized in shoes and which can eliminate sole pains caused to the wearer during walking operation.

2. Description of the Prior Art

It is said that when a man is walking, his feet must bear a burden of 0.8~1.2 times of the body. Since the reaction force of the foot from the ground is applied on the palm or arch of the foot sole, knee or backbone, it is generally advisable to insert insoles within a pair of shoes to absorb the shock of the foot, thereby avoiding the sole problem caused due to long term impact of the foot against the ground during walking.

U.S. Pat. No. 7,140,126 has proposed an arch support insole, which generally provides cushion effect to the wearer. The arch support insole is generally made from rubber material, such as silicone, to counteract the reaction force of the ground and to absorb the impact of foot against the ground during walking. However, it is noted that the cushion effect and the impact absorption ability is limited.

A human foot includes generally a forefoot, an aft foot and a midfoot (arched foot) bridging the two and is upwardly arched so that in the normal condition the midfoot provides springy, elastic structure and to absorb shock. Since a conventional shoe includes a traditional insole that does not provide support at the midfoot except the heel and toes, a man's foot suffers from fatigue due to over work, long time walking or standing in unbalanced position, hence causing plantar fasciitis. It is noticed that for walking forward or backward, it is the toe or heel portion that exerts pressure against the ground to provide friction for moving forward and rearward direction.

SUMMARY OF THE INVENTION

The main objective of the present invention is to provide an arch support insole for use within a pair of shoes so that the palm, arch and heel support portions of the support insole can absorb the shock of feet while walking so as to eliminate or reduce the pain caused by a traditional insole.

The arch support insole of the present includes a basic body made from soft flexible material having a top surface, a palm support portion, an arch support portion and a heel support portion. The palm support portion has an arched lateral side projecting upwardly from the top surface of the basic body to a predetermined thickness and simultaneously forming a first acute angle. The arch support portion surrounds the rear part and the curved side surface of the palm support portion, has an upwardly curved top surface with a topmost point, which is spaced from the top surface of the basic body at a predetermined thickness. Thus, once a wearer puts on the shoes provided with the arch support insoles of the present invention, the feet of the wearer are ergonomically supported by the support insoles of the present invention, and hence providing comfortable feeling to the wearer.

Preferably, the abovementioned soft flexible material is selected from a group consisting of thermoplastic rubber (TPR), thermoplastic elastomer (TPE), thermoplastic polyurethanes (TPU), silicone, poron, polyurethane, ethylene vinyl acetate (EVA), sponge and rubber, from which the arch support insole thereof is produced via injection or extrusion process so that the arch support insole thus formed has a contour conforming with the interior of shoe, into which, the support insole is inserted. The basic body accordingly includes a palm support portion having a rear part, a front part with a width gradually increased from the rear part, an arched lateral side conforming to an arch of human foot, a topmost planar surface and a curved side surface gradually descending from the topmost planar surface, the topmost planar area being spaced apart from the top surface of the basic body at 7 mm~9 mm. The arch support portion surrounds the rear part and the curved side surface of the palm support portion, has an upwardly curved top surface with a topmost point which is spaced from the top surface of the basic body at 1 mm~4 mm. The heel support portion has an upwardly curved surface with a topmost point which is spaced from the top surface of the basic body at 2 mm~5 mm.

It is noticed that since the heel of a human foot is not aligned fully with a connection line extending symmetrically and interconnecting the front and rear ends of the foot. The palm support portion is ergonomically formed in order to provide comfort feeling upon touching with the basic body, once the wearer puts on the shoes provided with the arch support insoles of the present invention. To be more specific, the basic body defines a longitudinal axis extending symmetrically through a central portion thereof. The palm support portion has a first central line extending through the middle of the front and rear ends defining a first acute angle in cooperation with the longitudinal axis of the basic body. The acute angle ranges from 4°~9°. After conducting an experiment, it is discovered that the above stated angle provides a comfortable feeling once the wearer puts on the shoes provided with the arch support insoles of the present invention.

In order for the arch support portion comfortably abutting against the arch of the wearer's foot, the arch support portion has a second central line extending through the middle of the front and rear ends thereof and defining a second acute angle in cooperation with the longitudinal axis of the basic body. Preferably, the second acute angle ranges between 30°~45°.

It is discovered that when the heel support portion has a longitudinal length ranging between 35 mm~40 mm and a width ranging between 35 mm~38 mm, the support insole of the present invention provides the maximum comfortable feeling to a wearer due to the reasons that once the wearer's foot is placed on the arch support insole of the present invention, the toes, arch and heel of the wearer's foot are fully supported by the palm support portion, the arch support portion and the heel support portion.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
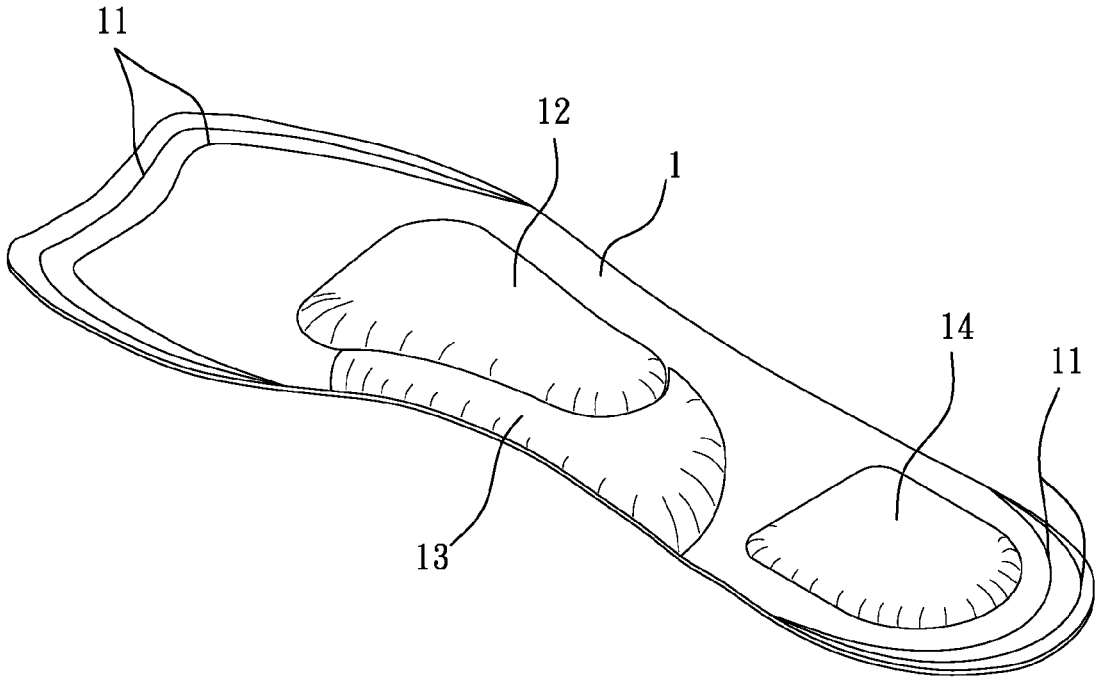
FIG. 1 shows a perspective view of an arch support insole of the present invention.
Figure 2:
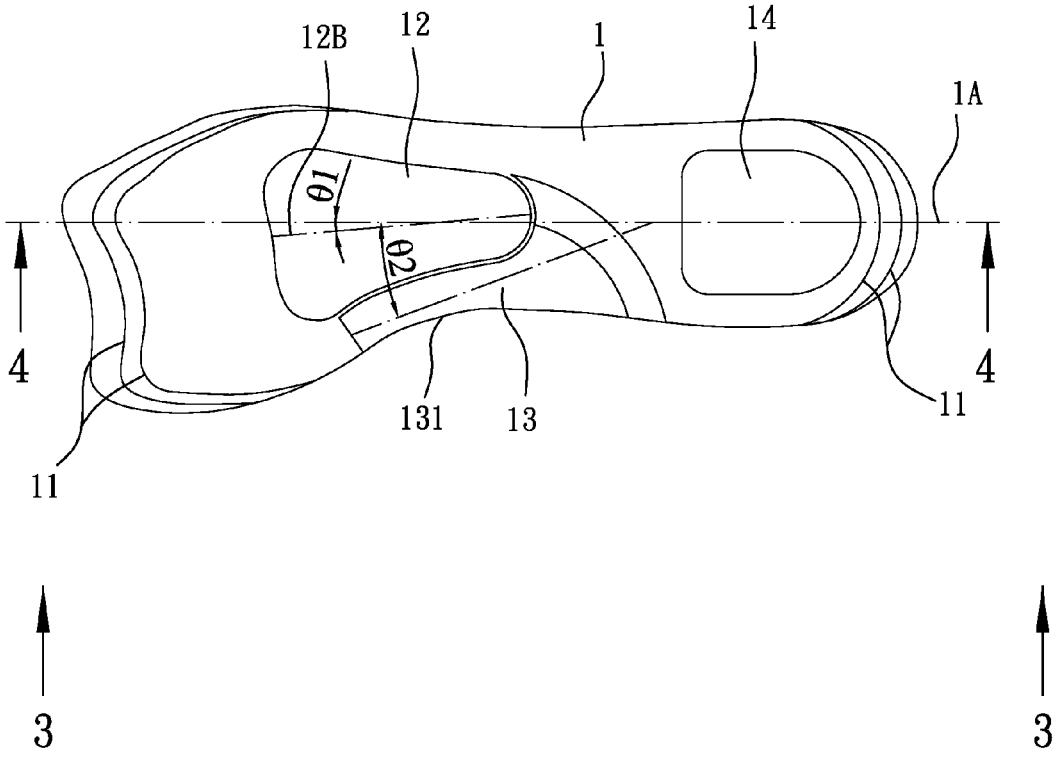
FIG. 2 is a top planar views of the arch support insole of the present invention shown in FIG. 1.
Figure 3:
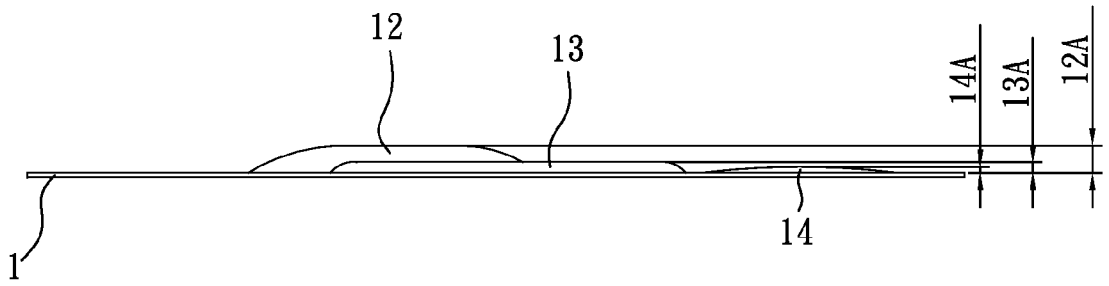
FIG. 3 is a cross-sectional view of the arch support insole of the present invention taken along Line 3-3 in FIG. 2.
Figure 4:
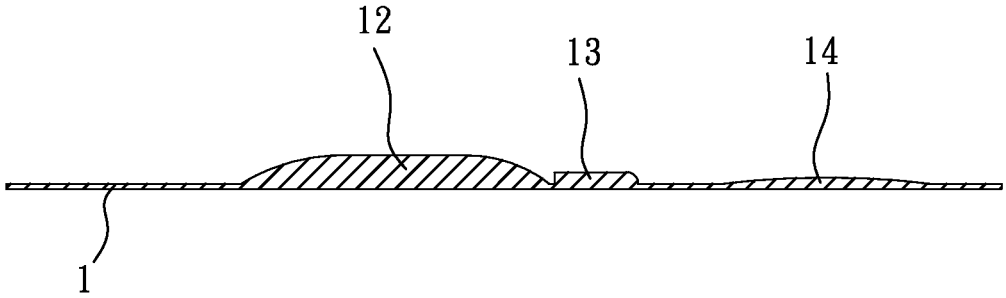
FIG. 4 is a cross-sectional view of the arch support insole of the present invention taken along Line 4-4 in FIG. 2.
Figure 5:
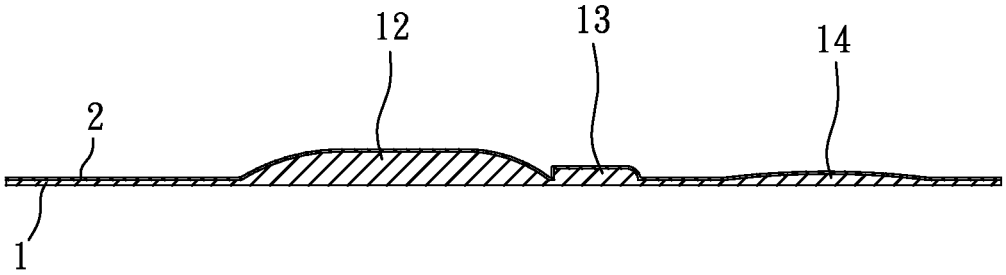
FIG. 5 is a cross-sectional view of the arch support insole of the present invention coated with a protection layer.

Referring to FIGS. 1 to 5, wherein FIG. 1 shows a perspective view of an arch support insole of the present invention;

FIG. 2 is a top planar views of the arch support insole of the present invention shown in FIG. 1; FIG. 3 is a cross-sectional view of the arch support insole of the present invention taken along Line 3-3 in FIG. 2; FIG. 4 is a cross-sectional view of the arch support insole of the present invention taken along Line 4-4 in FIG. 2 and FIG. 5 is a cross-sectional view of the arch support insole of the present invention coated with a protection layer.

As illustrated above, an arch support insole of the present invention includes one piece integral basic body 1 made from soft flexible material, having a top surface, a palm support portion 12, an arch support portion 13 and a heel support portion 14. The basic body 1 has a profile or contour conforming to an interior of a shoe to be inserted, has front and rear portions, which upper surfaces are formed with a plurality of seam lines 11 to facilitate a consumer to adjust after purchase the length of support insole in accordance with his or her foot length.

Referring to FIGS. 2 and 3, the palm support portion 12 has a rear part, a front part with a width gradually increased from the rear part, an arched lateral side formed ergonomically conforming to an arch of human foot and a topmost planar surface and a curved side surface 132 gradually descending from the topmost planar surface. The topmost planar area is spaced apart from the top surface of the basic body 1 at a first distance 12A ranging between 7 mm~9 mm, which provides the maximum comfortable feeling to a wearer.

Referring to FIGS. 2 to 4, since the heel of a human foot is not aligned fully with a connection line extending symmetrically and interconnecting the front and rear ends of the foot, the palm support portion 12 is ergonomically formed in order to provide comfort feeling upon touching with the basic body 1, once the wearer puts on the shoes provided with the arch support insoles of the present invention. To be more specific, the basic body 1 defines a longitudinal axis 1A extending symmetrically through a central portion thereof. The palm support portion 12 has a first central line 12B extending through the middle of the front and rear ends defining a first acute angle θ1 in cooperation with the longitudinal axis 1A of the basic body 1. In this embodiment, the acute angle θ1 ranges from 4°~9'.

Referring to FIGS. 2 to 4, the arch support portion 13 surrounds the rear part and the curved side surface 132 of the palm support portion 12, has an upwardly curved top surface with a topmost point, which is spaced from the top surface of the basic body 1 at a second distance 13A. In this embodiment, the second distance 13A ranges between 1 mm~4 mm, which provides the maximum comfortable feeling to a wearer. Moreover, the arch support portion 13 had a second central line extending through the middle of the front and rear ends thereof and defining a second acute angle θ2 in cooperation with the longitudinal axis 1A of the basic body 1. In this embodiment, the second acute angle θ2 ranges between 30°~45°.

The heel support portion 14 has an upwardly curved surface with a topmost point, which is spaced from the top surface of the basic body 1 at a third distance 14A. In this embodiment, the third distance 14A ranges between 2 mm~5 mm, which provides the maximum comfortable feeling to a wearer.

The abovementioned soft flexible materials is selected from a group consisting of thermoplastic rubber (TPR), thermoplastic elastomer (TPE), thermoplastic polyurethanes (TPU), silicone, poron, polyurethane, ethylene vinyl acetate (EVA), sponge and rubber, from which the arch support insole thereof is produced via injection or extrusion process so that the palm support portion 12, the arch support portion 13 and the heel support portion 14 have contours conforming with the profile with the forefoot, midfoot and the aft foot of the wearer's foot.

FIG. 5 is a cross-sectional view of the arch support insole of the present invention coated with a protection layer. As illustrated, depending of the requirement of the condition, a protection layer 2 is coated over the top surface of the basic body 1, thereby covering the palm support portion 12, the arch support portion 13 and the heel support portion 14. The material for the protection layer 2 is selected from group consisting of clothing or other material so long as the latter provides thickness and water absorption ability. An adhesive is applied to the protection layer 2 and the top surface of the basic body 1, after which, the assembly is put in a mold for undergoing molding procession so as to form one integral piece.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An arch support insole comprising:

a basic body made from soft flexible material having a top surface, a palm support portion, an arch support portion and a heel support portion, wherein said palm support portion having a rear part, a front part with a width gradually increased from said rear part, an arched lateral side conforming to an arch of human foot, a topmost planar surface and a curved side surface gradually descending from said topmost planar surface, said topmost planar area being spaced apart from said top surface of said basic body at 7 mm~9 mm, wherein said arch support portion surrounds said rear part and said curved side surface of said palm support portion, has an upwardly curved top surface with a topmost point, which is spaced from said top surface of said basic body at 1 mm~4 mm, wherein said heel support portion having an upwardly curved surface with a topmost point, which is spaced from said top surface of said basic body at 2 mm~5 mm.

2. The arch support insole according to claim 1, wherein said basic body defines a longitudinal axis extending symmetrically through a central portion thereof, said palm support portion having a first central line extending through the middle of the front and rear ends defining a first acute angle in cooperation with said longitudinal axis of said basic body.

3. The arch support insole according to claim 2, wherein said first acute angle ranges between 4°~9°.

4. The arch support insole according to claim 2, wherein said arch support portion having a second central line extending through the middle of the front and rear ends thereof and defining a second acute angle in cooperation with said longitudinal axis of said basic body.

5. The arch support insole according to claim 4, wherein said second acute angle ranges between 30°~45°.

6. The arch support insole according to claim 2, wherein said heel support portion has a longitudinal length ranging between 35 mm~40 mm and a width ranging between 35 mm~38 mm.

7. The arch support insole according to claim 1, further comprising a protection layer coated on said top surface of said basic body, thereby covering said palm support portion, said arch support portion and said heel support portion.

* * * * *